United States Patent [19]

Dysart

[11] 4,080,240

[45] Mar. 21, 1978

[54] COATED TAPE APPLICATOR FOR DRY WALLS

[76] Inventor: Norman A. Dysart, 8120 Amarillo Blvd. E., Amarillo, Tex. 79107

[21] Appl. No.: 765,417

[22] Filed: Feb. 3, 1977

[51] Int. Cl.[2] ..... B44C 9/08

[52] U.S. Cl. ..... 156/575

[58] Field of Search ..... 156/575

[56] References Cited

U.S. PATENT DOCUMENTS

| | | | |
|---|---|---|---|
| 2,323,963 | 7/1943 | Ames | 156/575 |
| 3,116,195 | 12/1963 | Lathrup et al. | 156/575 |
| 3,880,701 | 4/1975 | Moree | 156/575 |
| 3,960,643 | 6/1976 | Dargitz | 156/575 |
| 4,003,781 | 1/1977 | Holsten | 156/575 |

*Primary Examiner*—Douglas J. Drummond
*Attorney, Agent, or Firm*—Lyon & Lyon

[57] ABSTRACT

An applicator for dispensing a tape coated with an adhesive compound onto a dry wall, particularly along the abutting margins of the dry wall panels, the applicator including a housing containing a reel from which the tape is dispensed, and a chamber through which the tape passes, the chamber having a distributor nozzle which applies a dry wall compound to the tape. The housing carries a set of applicator wheels over which the tape passes; the applicator wheels press the tape flat against the abutting margins of coplanar panels. The adhesive property of the dry wall compound is utilized to draw the tape through the applicator housing. A V-shaped pressing wheel is movable into engagement with the tape for the purpose of applying the tape to angularly disposed panels. The housing carries a tape cutter disposed adjacent the applicator wheels. A valve is provided to control the supply of the compound. Manual controls for the V-shaped pressing wheel and tape cutter are provided adjacent the valve for ready manipulation of the applicator.

6 Claims, 9 Drawing Figures

COATED TAPE APPLICATOR FOR DRY WALLS

BACKGROUND

In the construction of dry walls, as distinguished from plastered walls, panels or wall board usually formed of gypsum are nailed or stapled to the wall studs or ceiling joists. It is essential that the abutting margins of coplanar panels as well as angular, usually 90°, related panels be covered and bonded together. This is usually accomplished by a paper tape having a coating of a viscous mixture with adhesive properties, identified in the trade as "mud" or "dry wall mud."

Usually the tape is manually coated with the mud and manually applied to the margins of adjacent panels, with the aid of hand tools. Automatic machines for coating and applying such tapes have been developed; however, such machines have been difficult to operate, requiring considerable practice before the user can become proficient.

SUMMARY

The present invention is directed to a coated tape applicator for dry walls, and is summarized in the following objects:

First, to provide an applicator, of the type indicated, which is compact and readily manipulated without requiring much practice in order to apply the tape, and although not requiring a motor drive and attendant complication, is adapted to apply the tape automatically as the applicator is moved manually over a wall or ceilling surface.

Second, to provide an applicator, of the type indicated, which utilizes the adhesiveness of the dry wall mud to withdraw the tape from the applicator over wheels which press the tape against a wall or ceiling surface as the applicator is moved thereon.

Third, to provide an applicator, of the type indicated, wherein the applicator is adapted to be attached through a manually controlled hand valve to a pressurized dry wall mud supply line, the applicator carrying a roll of tape which, as the tape is pulled from the rod, is automatically coated with the dry wall mud.

Fourth, to provide an applicator, of the type indicated, which includes a novelly arranged tape cutter and control arranged for ready manual operation, as the applicator completes application of a length of tape.

Fifth, to provide an applicator, of the type indicated, which includes a novelly arranged means manually operable after the tape is cut, to feed an initial portion of tape into position for application to a wall or ceiling.

DETAILED DESCRIPTION

Figure 2:
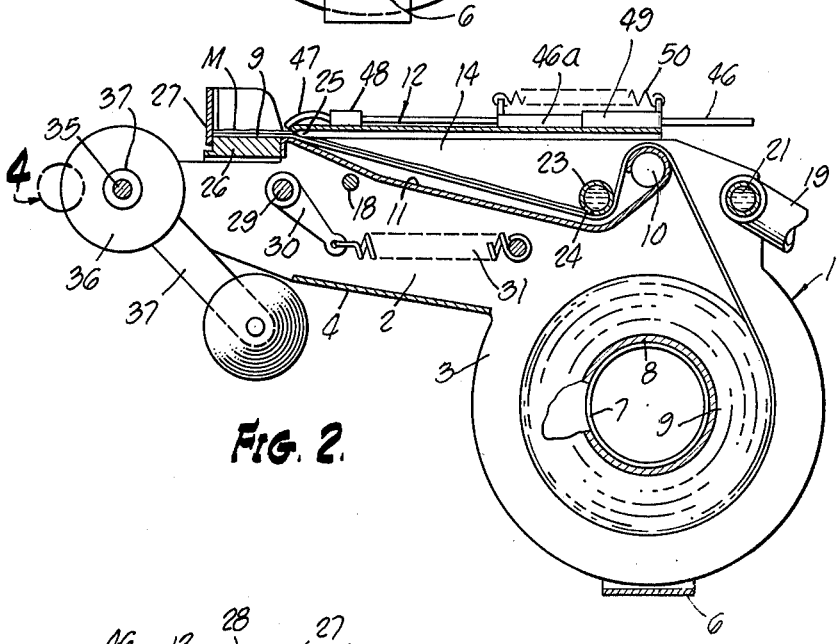
FIG. 2 is a partial sectional view taken through 2—2 of FIG. 5.

The coated tape applicator for dry walls includes a housing 1 having parallel side plates 2 having downwardly extending circular rearward portions 3. Forwardly of the circular portions 3, the side plates are joined by a cross web 4. One of the circular portions is provided with a hinge 5 and a disconnectable latch clip 6 joins the two circular portions to retain them in parallel relation. The circular portions 3 have coaxial confronting flanges 7 which receive a tape spool 8 on which is wound a roll of tape 9 as shown in FIG. 2.

The side plates are joined above the circular portions 3 by a cross rod 10 and a partition wall 11 is disposed between the plates 2 below their upper margins. The rear end of the partition wall 11 loops over the cross bar 10, and the forward portion of the partition wall slopes toward the upper edges of side plates 2 near their forward extremities.

The upper edges of the side plates 2 are joined by a removable cover plate 12 having side flanges 13 overlapping the upper margins of the side plates. Formed between the cover plate 12 and wall 11 is a tape receiving chamber 14. The rear ends of the flanges 13 are provided with retainer slots 15. The retainer slots engage retainer pins 16 projecting opposite ends of the cross rod 10. The forward end of the cover plate 12 is provided with depending perforated extensions 17 of the flanges 13 which receive a removable retainer rod 18. The retainer rod extends through the side plates and is provided with a knob at one end for insertion or removal.

Located above and rearwardly of the circular portions 3 of the side plates 2 is a dry wall mud intake tube 19 forming a rearwardly extending handle 20. The forward end of the tube 19 is joined to a cross tube 21 which in turn is joined to parallel portions 22 extending along opposite sides of the side plates 2 and are joined by a second cross tube 23 which traverses the tape receiving chamber 14 and is provided with a discharge slot 24 as shown in FIG. 2. The forward end of the cover plate 12 forms with the partition 11 a discharge slot 25.

Extending forwardly from the housing 1 is a fixed tape cutter plate 26 having a cutter edge at its forward extremity. The butting edge of the plate 25 is engaged by a movable blade 27 having pivot arms 28 extending along opposite sides the applicator housing and joined by a pivot shaft 29 traversing the applicator housing 1. The shaft 29 is provided with a lever 30 within the applicator housing which is attached to a spring 31 positioned to urge the movable blade into cutting relation with the fixed plate 26. Attached to one of the pivot arms 28 is a rearwardly extending pull rod 32 which extends into a latch bracket 33 so arranged as to hold the rod in its rearward position so that the movable blade 27 normally clears the cutter plate 26. Upon release of the pull rod from the latch bracket 33 the spring 31 causes the blade 27 to sever the tape extending across the cutter plate 26.

Figure 4:
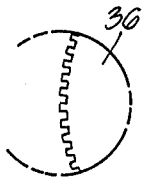
FIG. 4 is an enlarged fragmentary view of one of the roller discs taken within circle 4 of FIG. 2.

The applicator housing 1 is provided with forwardly directed journal extensions 34 joined by a transverse shaft 35 which carries a set of freely rotatable roller discs 36 having serrated peripheries as indicated in FIG. 4. The roller discs 36 are separated by spacer sleeves 37.

Figure 1:
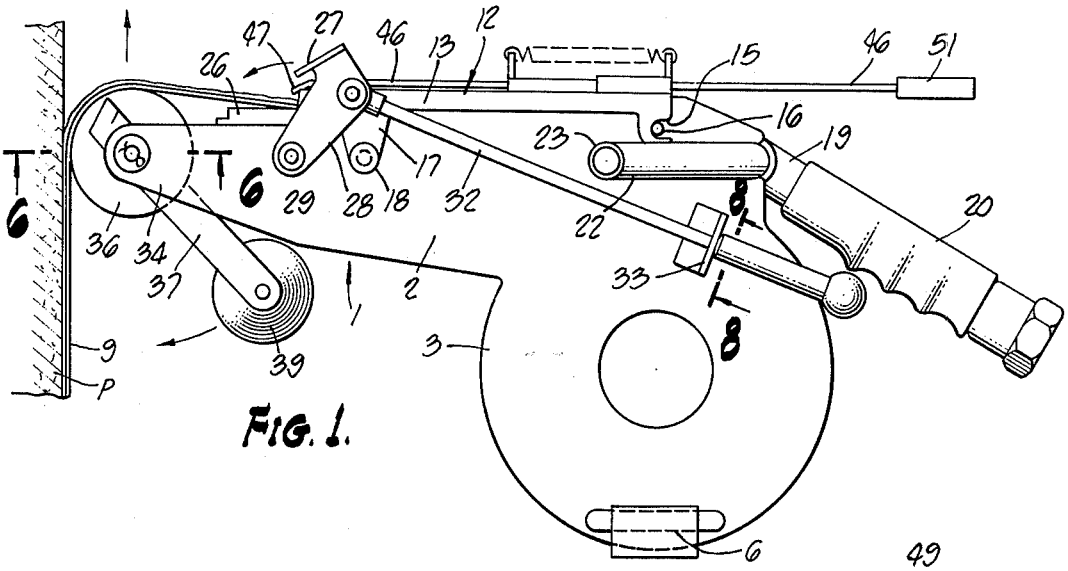
FIG. 1 is a side view of the coated tape applicator for dry walls taken as indicated by 1—1 of FIG. 5.

The shaft 35 is provided adjacent to the journal extensions 34 with a pair of lever arms 38, the extremities of which journal a V-shaped roller 39. As will be explained herienafter, the lever arms move the V-shaped roller 39 between a retracted position as shown in FIGS. 1 and 2 and an extended position shown in FIG. 3. This movement is accomplished by a link 40 joined to one of the lever arms 38. The link 40 is joined at one end to a lever 41 pivoted intermediate to its ends. The remaining end of pivot lever 40 is joined to a rod 42 which extends through a guide 43 and terminates in a handle 44. One of the lower arms 38 may be provided with a stop for limiting outward movement or forward movement of the V-shaped roller 39.

Mounted on top of the cover plate 12 and extending in a longitudinal direction is a tape advancing strip 46 formed of thin leaf spring material. The forward end of the strip overlies the fixed tape cutter plate 26 and is provided with a pointed forward tip 47. The strip is capable of forward and rearward movement by means of a forward guide 48 and a rearward guide 49. A spring 50, attached to a band **46*a* secured to strip 46, connects the strip 46 with the rearward guide 49 so as to hold the tip 47 in a rearward and raised position. The rearward end of the strip 46 is provided with an appropriate handle 51. The strip 46 is biased downward so that, on forward movement, the tip 47** moves downward to engage the tape and push it forward.

The intake tube 19 is connected to a dry wall mud supply line 52 through a hand operated valve 53. The supply line 52 is connected to a pair of alternately operable supply tanks 54 through separate valves 55. The supply tanks are provided with removable heads 56 and each receives a floating piston 57. A compressed air unit 58 is provided which includes alternately operable airlines 59 provided with valves 60 alternately connectable to the upper or lower ends of the supply tanks so that the floating pistons 57 may be forced downward to deliver dry wall mud, or raised and removed with the heads 56 for refill.

Operation of the applicator for dry wall compound coated tape is as follows:

Initially, the end of a roll of tape 9 is passed over the cross rod 10 and under the cross tube 23 so as to receive mud 17 from the discharge slot 24. The tape 9 extends to the forward end of chamber 14 and over the fixed tape cutting plate 26. During initial operation, the valve 53 is operated to supply the desired amount of mud onto the upper surface of the tape. When the mud coated tape reaches the cutter plate 26, the uncoated portion of the tape is severed and the coated tape is advanced over the roller discs 36 to the extent that the end of the tape may be applied at the juncture J between a pair of coplanar dry wall panels P. If the panels be wall panels, the end of the tape is applied to the lower end of the juncture therebetween. While pressure is applied manually through the applicator to the rollers 36, the applicator is moved upwardly over the juncture J to the top extremity thereof at which point the knife 26 is operated to sever the tape 9. If the panels are ceiling panels, the same operation is accomplished by pressing upwardly and longitudinally of the ceiling panels.

Figure 3:
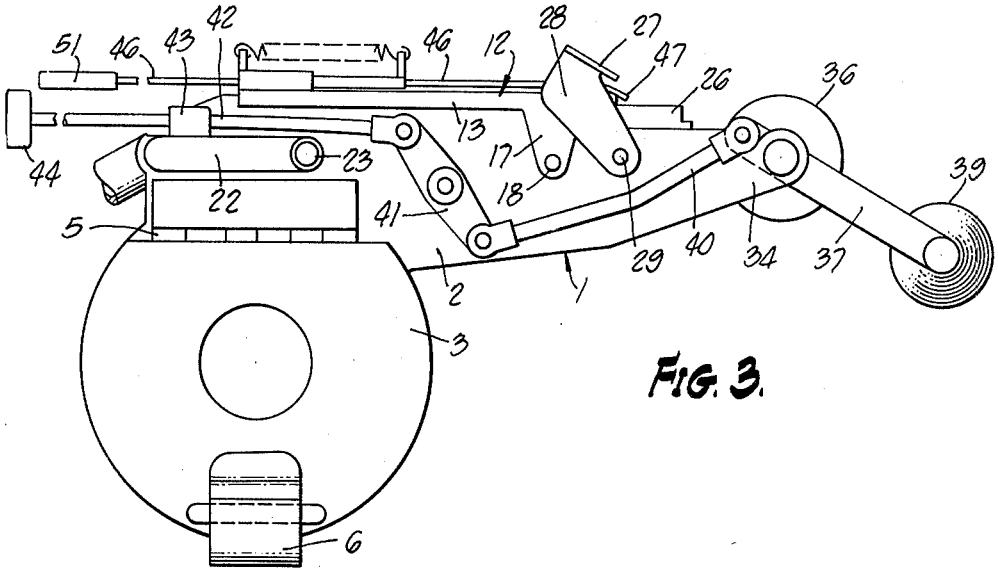
FIG. 3 is a side view taken in the opposite direction from FIG. 1, that is from 3—3 of FIG. 5.
Figure 5:
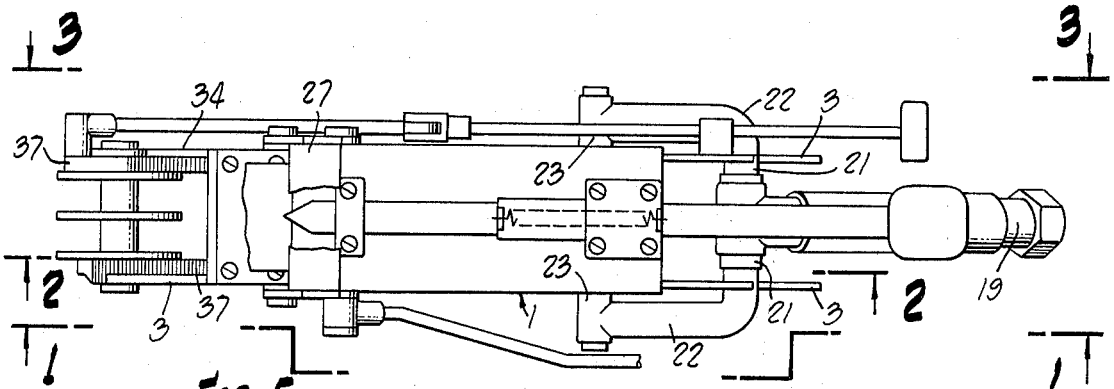
FIG. 5 is a plan view of the applicator.
Figure 6:
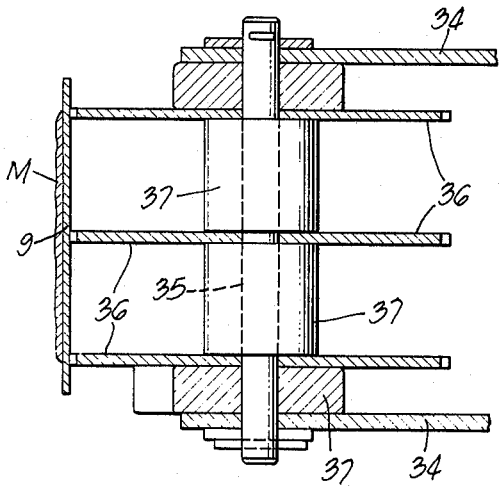
FIG. 6 is an enlarged fragmentary sectional view taken through 6—6 of FIG. 1 with the wall panel omitted.
Figure 7:
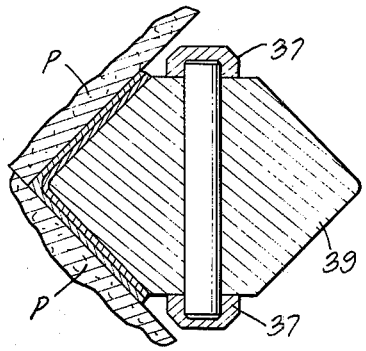
FIG. 7 is an enlarged fragmentary sectional view of the V-shaped roller utilized for pressing the tape between angularly related wall board panels, the panels being indicated fragmentarily.
Figure 8:
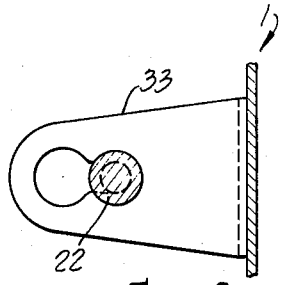
FIG. 8 is a fragmentary sectional view taken through 8—8 of FIG. 1.
Figure 9:
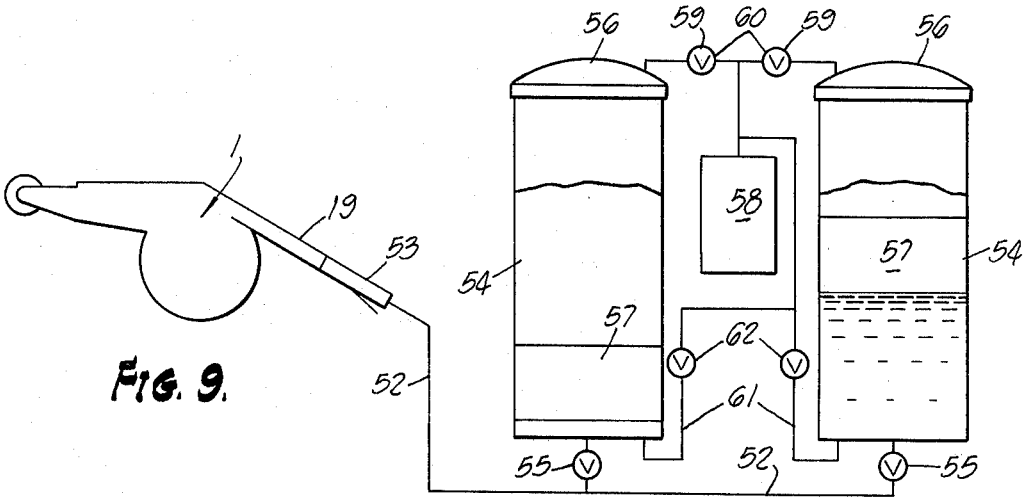
FIG. 9 is a diagramatical view showing the relationship of the applicator to source of supply of the dry wall coating.

If the panels are disposed in right angular relation as in the corner of a room or in the corner between the ceiling and wall, the V-shaped roller 39 is moved from its retracted position shown in FIGS. 1 and 2 to the extended position shown in FIG. 3 and the coated tape is extended over the V-roller and pressed into a corner as shown in FIG. 7.

Having fully described my invention, it is to be understood that I am not to be limited to the details herein set forth, but that my invention is of the full scope of the appended claims.

I claim:

1. In a tape applying device, a housing comprising laterally spaced side walls and support means between said side walls for rotatably mounting a roll of tape;

a top wall extending between said side walls;

a partition wall extending between said side walls below said top wall to define a tape coating chamber, the partition wall having forward and rear end edges spaced from said top wall;

a discharge tube extending laterally through said chamber above a portion of said partition wall, said tube having a longitudinal slot therein adjacent the bottom thereof;

means for feeding adhesive into said tube; and means for guiding tape from a roll of tape on said support means to extend along a path between the rear end of said partition wall and said top wall, slidably against the bottom of said discharge tube adjacent said slot, then outwardly of said chamber between the forward end of said partition wall and said top wall to a roller on said device for pressing said tape against a surface.

2. A device as defined in claim 1 wherein said top wall is hinged to one of said side walls whereby it may be selectively moved to provide access to said coating chamber.

3. A device as defined in claim 1 including at least one rod extending between said side walls, the rear end portion of said partition wall being looped over said rod and providing a tape guiding surface.

4. A device as defined in claim 1 wherein a portion of one of said side walls adjacent said support means is hingedly mounted to provide access to said support means for mounting a roll of tape thereon.

5. A tape applying means, as defined in claim 1, wherein:

a. a tape cutter means is carried by the forward end of the housing to sever the tape at preselected points.

6. A tape applying means, as defined in claim 5, wherein:

a. a manually operable means is mounted on the housing for moving the extended end of the tape over the roller means.

* * * * *